US006854925B2

(12) United States Patent
DiTullio

(10) Patent No.: US 6,854,925 B2
(45) Date of Patent: Feb. 15, 2005

(54) STORM WATER RESERVOIR WITH LOW DRAG

(76) Inventor: Robert J. DiTullio, 170 Lake Rd., Warren, CT (US) 06754

( * ) Notice: Subject to any disclaimer, the term of this patent is extended or adjusted under 35 U.S.C. 154(b) by 0 days.

(21) Appl. No.: 10/233,975

(22) Filed: Sep. 3, 2002

(65) Prior Publication Data

US 2004/0101369 A1 May 27, 2004

(51) Int. Cl.[7] ..... E02B 13/00; E02B 11/00; F16L 11/15

(52) U.S. Cl. ..... 405/49; 405/36; 405/43; 405/46; 405/124; 138/105; 138/128; 138/173

(58) Field of Search ..... 405/36, 43–49, 405/124; 138/105, 121, 128, 156, 170, 173, 177; 210/170, 747; D23/200, 207, 267

(56) References Cited

U.S. PATENT DOCUMENTS

| | | | | | |
|---|---|---|---|---|---|
| 980,442 | A | * | 1/1911 | Shafly | 405/48 |
| 3,830,373 | A | * | 8/1974 | Sixt | 210/489 |
| 3,926,222 | A | * | 12/1975 | Shroy et al. | 138/122 |
| 3,957,084 | A | * | 5/1976 | Jung | 138/122 |
| 4,182,580 | A | * | 1/1980 | Hieda et al. | 405/43 |
| 4,182,581 | A | * | 1/1980 | Uehara et al. | 405/43 |
| 4,950,103 | A | * | 8/1990 | Justice | 405/43 |
| 5,335,945 | A | * | 8/1994 | Meyers | 285/236 |
| 5,839,477 | A | * | 11/1998 | Murayama | 138/121 |
| 5,890,837 | A | * | 4/1999 | Wells | 405/43 |
| 5,921,711 | A | * | 7/1999 | Sipaila | 405/45 |
| 5,996,635 | A | * | 12/1999 | Hegler | 138/109 |
| 6,076,992 | A | * | 6/2000 | Fukui et al. | 405/43 |
| 6,126,209 | A | * | 10/2000 | Goddard | 285/347 |
| 6,129,482 | A | * | 10/2000 | Ditullio | 405/43 |
| 6,322,288 | B1 | * | 11/2001 | DiTullio | 405/43 |
| 6,461,078 | B1 | * | 10/2002 | Presby | 405/49 |
| 2001/0013673 | A1 | * | 8/2001 | Sifred et al. | 138/121 |
| 2002/0044833 | A1 | * | 4/2002 | Kruger et al. | 405/43 |

FOREIGN PATENT DOCUMENTS

| | | | |
|---|---|---|---|
| WO | 9102143 | * | 2/1991 |

* cited by examiner

*Primary Examiner*—Jong-Suk James Lee
(74) *Attorney, Agent, or Firm*—St. Onge Steward Johnston & Reens LLC

(57) ABSTRACT

A system using pre-molded polyethylene galleries, utilized for septic or storm water applications, to facilitate rapid and even distribution of effluent and particles across the gallery installation when utilized as a septic system, or minimizes the resistance to storm water flow when used to dissipate storm water runoff.

23 Claims, 6 Drawing Sheets

STORM WATER RESERVOIR WITH LOW DRAG

FIELD OF THE INVENTION

The present invention relates to pre-molded galleries utilized for storm water and septic systems that facilitate distribution of effluent and particles while presenting low surface-friction interior walls.

BACKGROUND OF THE INVENTION

Storm water and septic systems have been in wide use for many years. Pre-molded Polyethylene galleries have also been utilized for leaching and drainage systems. The advantage to utilizing these galleries is that they are lightweight, easy and quick to install, and relatively inexpensive.

Most of the water used in households around the United States is employed to carry off wastes, the majority of these wastes being organic and inorganic solids. In cities, wastewater is often collected in a sewer system and carried away to central sewage treatment plants. However, in rural and often in suburban residential areas, individual septic systems are used to treat household waste.

Septic systems are utilized to process waste and wastewater so that the water can seep into the sub-soil of the surrounding ground. Typically septic systems are comprised of a cement septic tank buried in the ground along with a leaching field extending from the septic tank. Once the waste and wastewater is deposited in the septic tank, solid particles sink to the bottom and small light particles rise to the surface with liquid layer called effluent being located between.

The effluent exits the septic tank through a pipe by means of hydrostatic pressure in the tank. The effluent flows into an adjoining leaching or drain field where it is permitted to seep through the surrounding ground.

Pre-molded Polyethylene galleries have increasingly been utilized for leaching and drainage systems. Such a system is disclosed in U.S. Pat. No. 5,087,151 to DiTullio ("the '151 patent") the disclosure of which is hereby incorporated by reference, which discloses a drainage and leaching field system comprising vacuum-molded polyethylene galleries that are designed to be connected and locked together in an end-to-end fashion. The '151 patent provides a lightweight, easy to install and structurally sound installation.

The galleries disclosed in the '151 patent comprise a single pre-molded polyethylene layer with an arch-shaped configuration having upstanding ribs running transverse to the length of the gallery. The ribs provide compressive strength to the gallery where, often it is desired to install the galleries under parking areas and under roadways. However, because the galleries are made of only a single layer the ribs form a corrugated and uneven surface on the interior walls of the galleries.

It is desirable to utilize the entire leaching field to distribute the effluent and particles that are deposited therein. However, most leaching fields are fed from one end and therefore the effluent and particles must travel the length of the connected galleries to be evenly distributed. Therefore, a build-up of particles can take place at the inlet end of the galleries, especially with the uneven surfaces forming pockets for particles to lodge in. In many cases, it is not feasible to feed the galleries from numerous points to achieve the desired distribution.

Galleries as disclosed in the '151 patent are also used to handle storm water runoff. Storm water drainage systems are usually separate from septic systems. In storm water drainage applications, the galleries are generally fed from one end and storm water is fed from gallery to gallery the length of the installation. During heavy rains, it is vital that the drainage system quickly take away the storm water that is deposited therein. The corrugated surface formed by the upstanding ribs on the interior walls of the galleries provide resistance to the flow of water thereby limiting the ability of the galleries to quickly process large quantities of storm water runoff in a limited time.

Therefore, what is desired is a leaching field utilizing pre-molded polyethylene galleries that facilitate the distribution of effluent and particles along its entire length.

It is also desired to provide a system utilizing pre-molded polyethylene galleries that present a low-friction surface on the interior walls for the quick removal of storm water runoff.

SUMMARY OF THE INVENTION

These and other objects are achieved by providing a pre-formed multi-layer gallery comprising multiple layers to form a single gallery for use in storm water and septic systems.

In one advantageous embodiment, a multi-layer plastic gallery is provided having first and second ends, the gallery forming an elongated interior space for liquid to flow therethrough, the multi-layer gallery comprising: a first exterior layer forming a smooth continuous surface along a substantial length of the gallery; a second middle layer forming a plurality of spaced apart upstanding ribs along a length of the gallery; and a third interior layer forming a smooth continuous surface along a second substantial length of the gallery.

In another advantageous embodiment, a multi-layer gallery is provided having first and second ends, the gallery forming a interior space for liquid to flow therethrough, the multi-layer gallery comprising: a first exterior layer running transversely to the length of the elongated section forming a plurality of spaced apart upstanding ribs; and a second interior layer forming a surface which is sufficiently smooth to reduce frictional drag of liquids flowing in the gallery.

In yet another advantageous embodiment, a method is provided for providing a multi-layer gallery with an elongated section having first and second ends and having a reduced coefficient of friction for an interior space to facilitate the flow of liquid and particles therethrough, including the steps of: providing a first exterior layer, the first exterior layer forming a plurality of upstanding ribs spaces apart along the elongated section and running transversely to the length of the elongated section; providing a second interior layer, the second interior layer forming a smooth continuous surface; and adhering the first exterior layer to the second interior layer to form a single multi-layer gallery.

In still another advantageous embodiment, a plastic gallery is provided for containing and distributing liquid in a leaching or drain field, said gallery comprising: an elongate arched body having first and second ends, said arched elongate body being formed of a corrugated layer and an inner plastic layer, said corrugated layer being a corrugated plastic having a plurality of ribs extending along a substantial length of said elongate body, said inner plastic layer being affixed to an inner surface of said corrugated layer and having a substantially smooth inner surface extending along a substantial length of said elongate arched body said substantially smooth inner surface having a low frictional drag with respect to liquid flow; and connecting means associated with said first and second ends for connecting a said gallery with another gallery.

The invention and its particular features and advantages will become more apparent from the following detailed description considered with reference to the accompanying drawings.

DETAILED DESCRIPTION OF THE DRAWINGS

Figure 1:
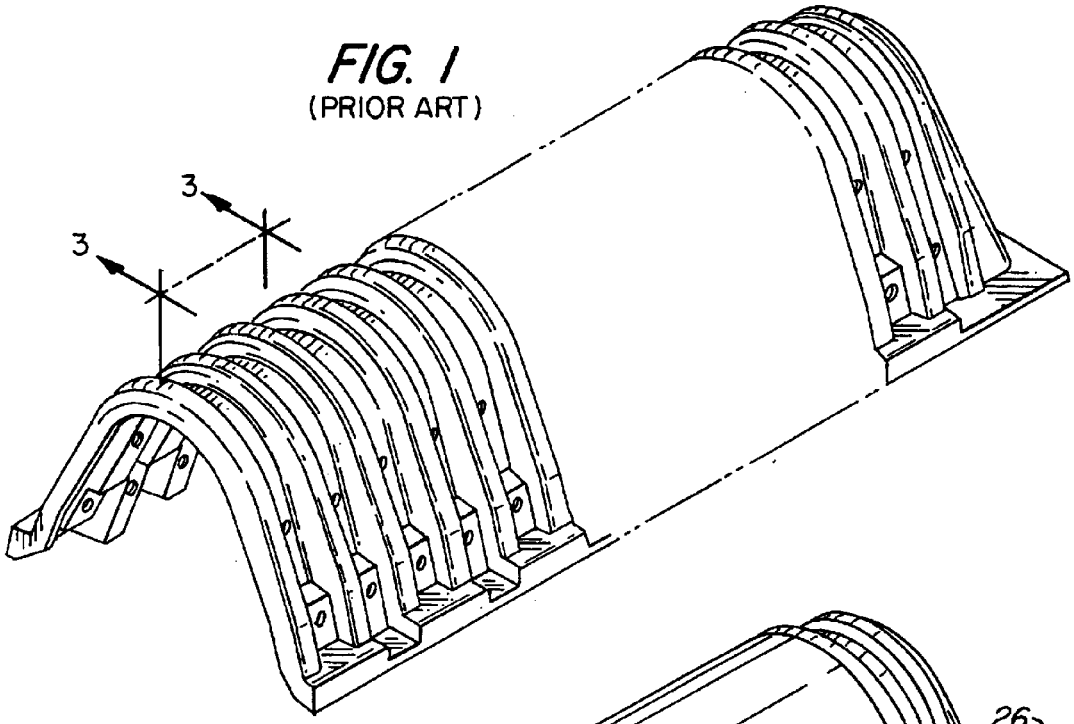
FIG. 1 (PRIOR ART)
FIG. 1 is a perspective view of a prior art plastic gallery.

FIG. 1 illustrates a gallery as disclosed in the prior art. The gallery has a body section having ribs spaced along and running transversely to the length of the body. The body forms an interior space, where the ribs extend downward to the bottom of the walls thereby creating an uneven surface. This uneven surface creates a series of pockets, both on the interior and exterior walls of the gallery, where solids may lodge and, which create frictional drag when the gallery is filled with a flowing fluid.

Figure 2:
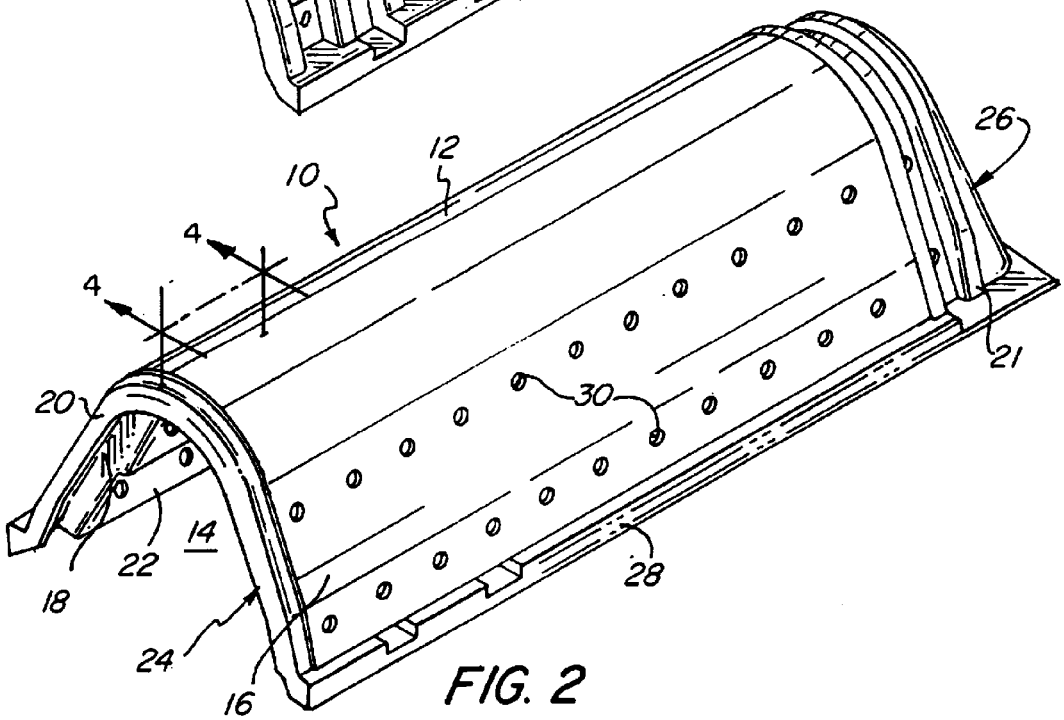
FIG. 2 is a perspective view of a first embodiment of a plastic gallery in accordance with the invention, using a triple wall construction.

FIG. 2 is an illustration of a first embodiment of the present invention, having a triple wall construction. A plastic gallery 10 is shown, having an elongated section 12 that forms an interior space 14. The gallery 10 comprises and exterior layer 16 that forms a smooth continuous surface over the outside of the gallery and terminates at the bottom portion of the gallery 10 with a flange 28. The gallery 10 also includes a middle layer 18 running transversely to the length of the elongated section 12 forming a plurality of spaced apart upstanding ribs 20. The gallery 10 further includes an interior layer 22 forming a smooth continuous surface over the interior of the elongated section 12.

Figure 3:
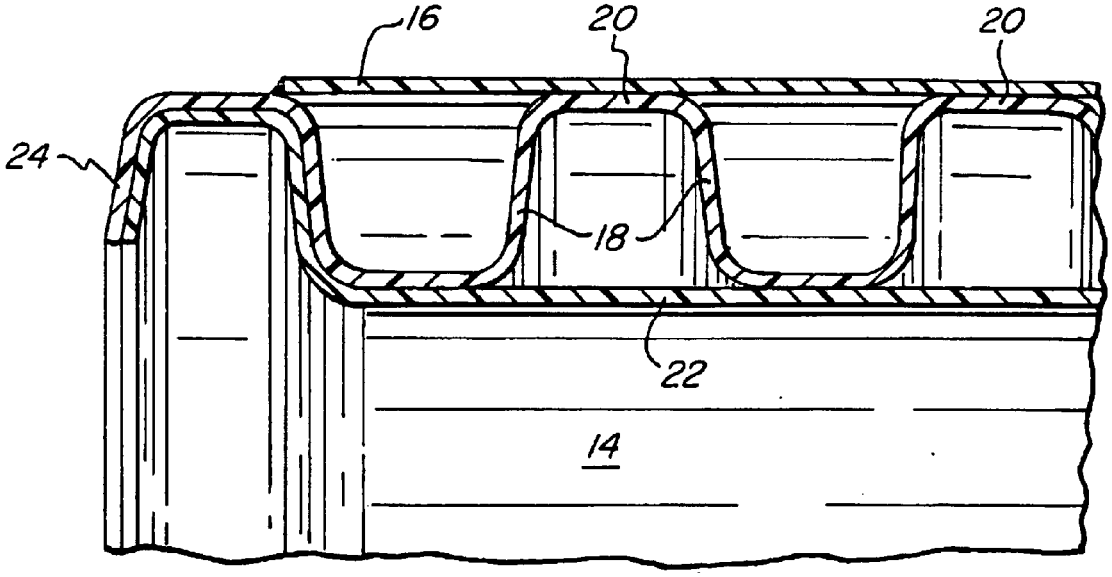
FIG. 3 is a cross-sectional view of the section of FIG. 1 along the line 3—3.

FIG. 3 is a cross-section of the prior art gallery illustrated in FIG. 1, showing the single-ply construction gallery known in the prior art. As can be seen by the section, an uneven surface is created by the corrugated ribs, which will impede the distribution of effluent and particle throughout the gallery. The irregularities create frictional drag due to turbulent fluid flow in high volume conditions when the gallery is used, for instance, for storm water management.

Figure 4:
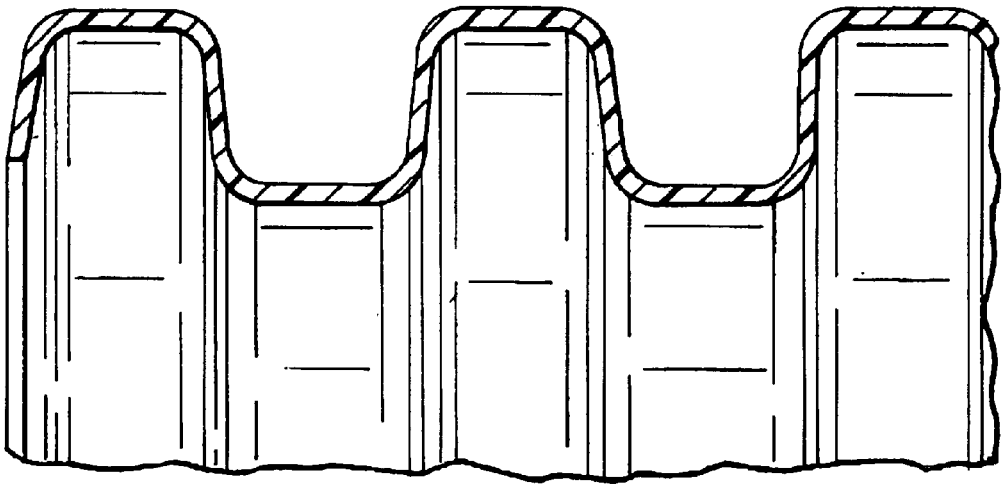
FIG. 4 (PRIOR ART)
FIG. 4 is a cross-sectional view of the section of FIG. 2 along the line 4—4.

FIG. 4 is a cross-section of FIG. 2, illustrating the present invention with the exterior layer 16, the middle layer 18, and the interior layer 22. As can readily be seen from the cross-section, these multi-ply layers form an interior wall layer 22 that is smooth and continuous across the interior surface. This will create a low frictional drag with respect to liquid flow as compared to the conventional corrugated interior surface and facilitate the even distribution of effluent and particles along the entire length of the gallery 10 or rapid distribution fluid flow under high volume conditions when the gallery is used, for instance, for storm water management, while the plurality of spaced apart upstanding ribs 20 provide the necessary structural rigidity. In addition, the smooth continuous interior wall layer 22 provides for even fluid flow distribution throughout the not only the gallery 10, but a substantial number of interconnected galleries as might be present in shopping center drainage applications.

Referring again to FIG. 2, the exterior layer 16 does not extend the entire length of the elongated section 12. Rather, the exterior layer 16 extends from the first end 24 and is terminated before the second end 26 of the elongated section 12 thereby exposing at least one upstanding rib 21 at the second end 26, or alternatively conforms to the shape of the ribbed middle layer 18. In addition, the interior layer 22 extends from the second end 26 and conforms to the ribbed middle layer 18 (or alternatively is terminated before the reaching the first end 24 of the elongated section 12) thereby providing an open underside of at least one upstanding rib 20 at the first end 24. The upstanding rib 20 at the first end 24 is larger than exposed rib 21 at second end 26 to facilitate the connection of galleries 10 in an end-to-end fashion as the upstanding rib 20 at the first end 24 of a first gallery 10 is fitted over the exposed upstanding rib 21 at the second end 26 of a second gallery 10, thereby mating two galleries 10 together in an end-to-end relationship. Alternatively, the gallery 10 may have multiple exposed upstanding ribs located at each end of the gallery 10.

In one embodiment, the elongated section 12 of the gallery 10 is further supplied with perforations 30, distributed along the length of the elongated section 12. The perforations 30 facilitate the flow of effluent out of the drain field gallery 10 in the adjoining leaching field if the gallery is to be used in a septic field or otherwise for wastewater management.

Figure 5:
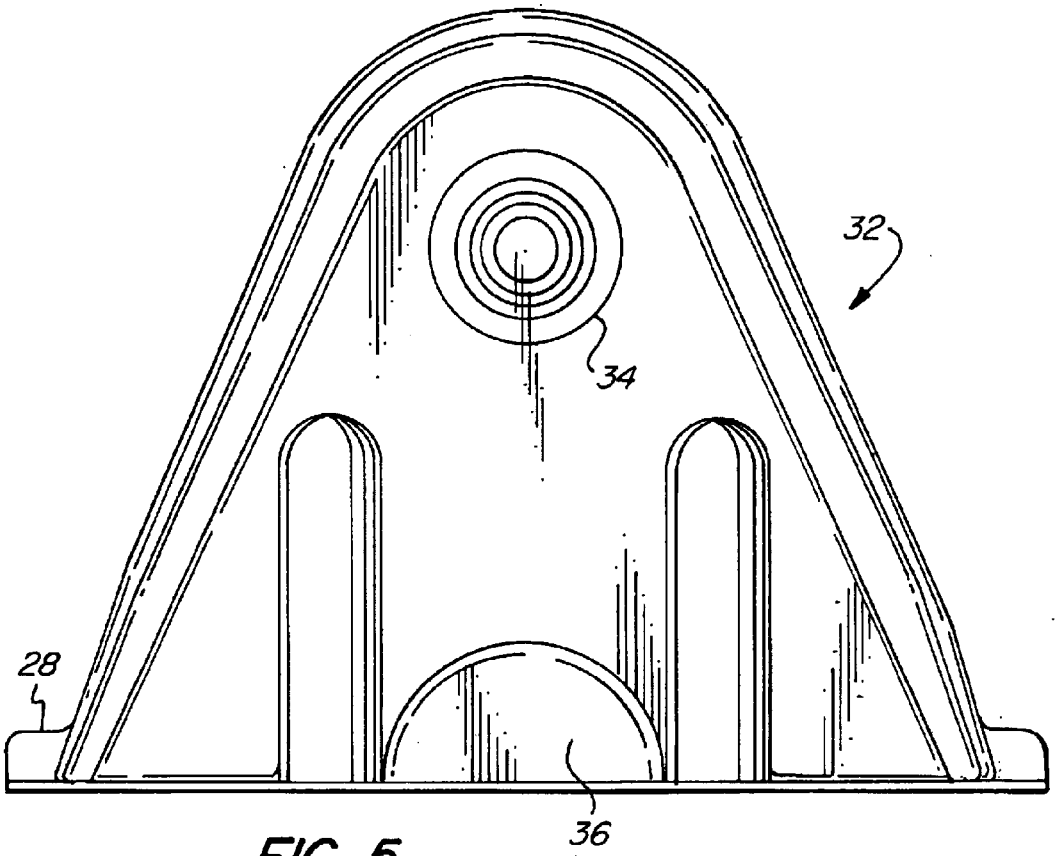
FIG. 5 is an elevation view of an end wall as used in an embodiment of the invention.

FIG. 5 depicts an illustration of an end wall 32 that may be utilized in conjunction with the gallery 10. The end wall 32 may be furnished with concentric perforations 34 provided so that a hole may be cut into the end wall 32 to the size of a feed pipe. In addition, the end wall may have a perforation 36, located at the base of the end wall 32, to facilitate the flow of effluent and solids, in the case of wastewater management, or storm water runoff, in the case of storm water management, from one gallery to the next. As the galleries may be utilized in many varying applications, the end wall 32 may provide structural support to the gallery 10 when, for instance, the system is installed under a parking area or a roadway where strong compression forces may be encountered.

Figure 6A:
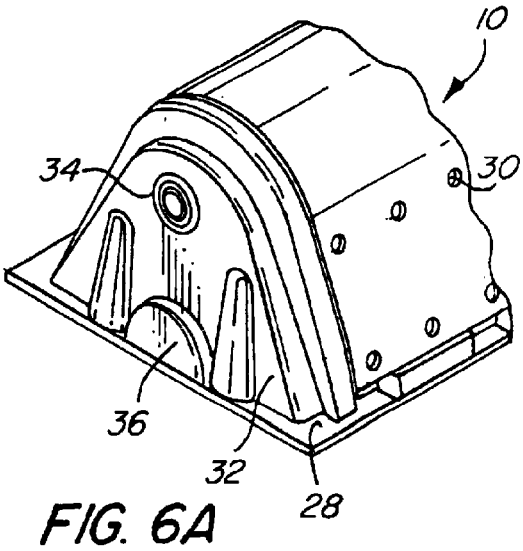
FIG. 6A is a perspective view of an integral end wall in one embodiment of the invention.
Figure 6B:
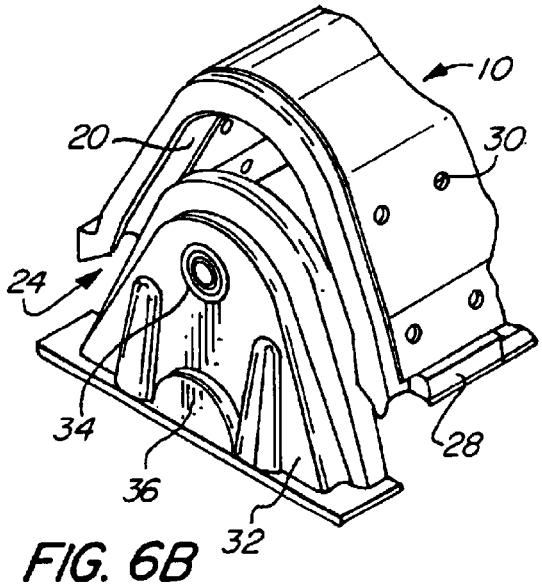
FIG. 6B is a perspective view of a separate end wall attachable to the gallery in another embodiment of the invention.

To that end, the end wall 32 may be either integral to the gallery 10 as depicted in FIG. 6A, or in the alternative, the end wall 32 may be detachably connectable to the gallery 10 as depicted in FIG. 6B. Where the end wall 32 is detachably connectable to the gallery 10 as illustrated in FIG. 6B, the end wall 32 may simply be attached to the gallery 10 in the same manner as attaching galleries in an end-to-end fashion, namely by fitting the end wall 32 into the exposed underneath of the at least one upstanding rib 20 at the first end 24 of the gallery 10.

Figure 7:
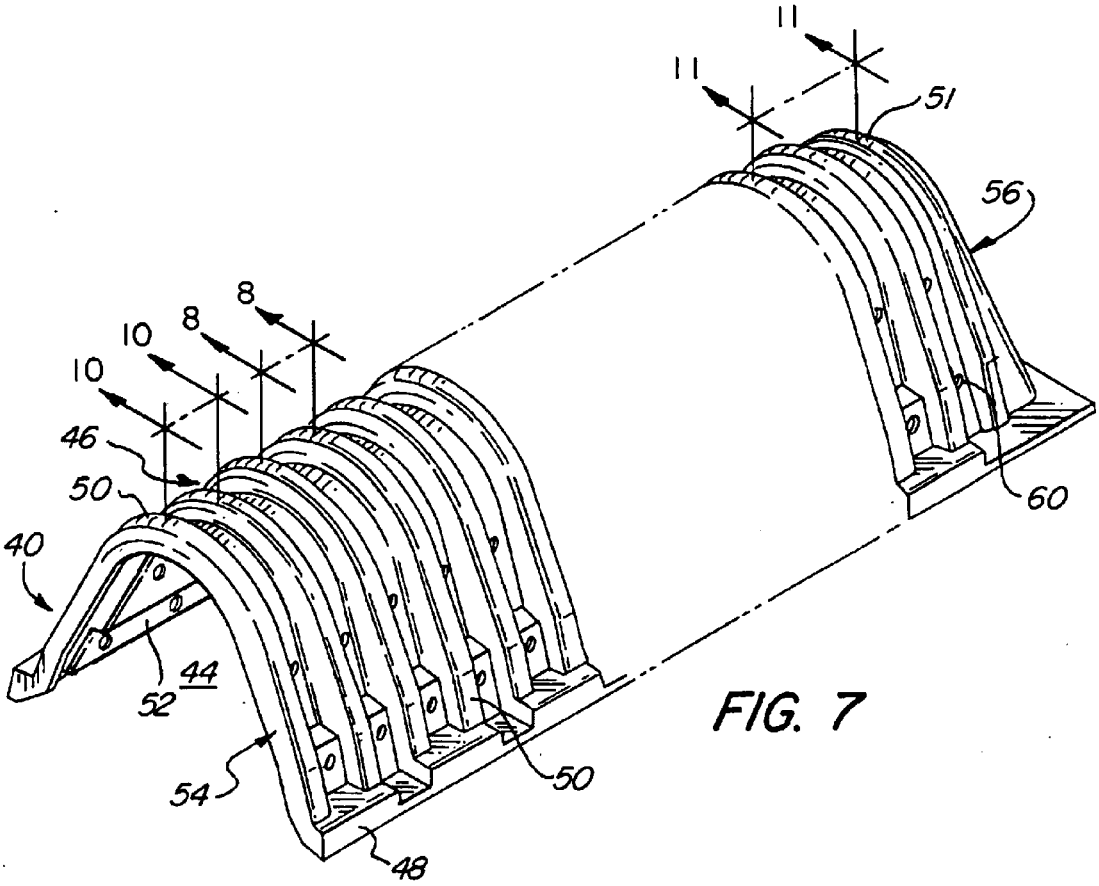
FIG. 7 is a perspective drawing of a second embodiment of the present invention, using a double wall construction.

FIG. 7 shows a second embodiment of the present invention, having a double wall construction. Plastic gallery 40 comprises an elongated section 42 that forms an interior space 44. The gallery 40 comprises a corrugated plastic arched exterior layer 46 that terminates at the bottom portion of the gallery 40 with a flange 48, the exterior layer 46 running transversely to the length of the elongated section 42 forming a plurality of spaced apart upstanding ribs 50. The gallery 10 further includes an arched interior wall layer 52 forming a smooth continuous surface over the interior of the elongated section 42. This will create a low frictional drag with respect to liquid flow as compared to the conventional corrugated interior surface.

Figure 8:
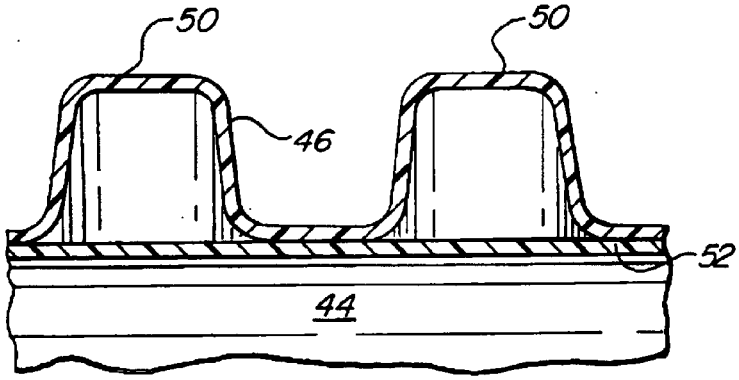
FIG. 8 is a cross-sectional view of the section of FIG. 7 along the line 8-8.

FIG. 8 is a cross-section of the gallery of FIG. 7, showing the exterior layer 66, and the interior wall layer 52. Again, as seen in FIG. 8, the problem of the prior art presented in FIG. 3, namely forming pockets that particles may tend to lodge in thereby inhibiting an even distribution of effluent and particles along the entire length of the gallery, or presenting resistance to fluid flow under high volume conditions when the gallery is used, for instance, for storm water management, are obviated by the embodiment shown in FIG. 8. These problems are minimized because the interior layer 52 forms a smooth continuous surface such that the effluent and particles will be more evenly distributed along the entire length of the gallery 40, while the plurality of spaced apart upstanding ribs 50 provide the necessary structural rigidity.

Figure 10:
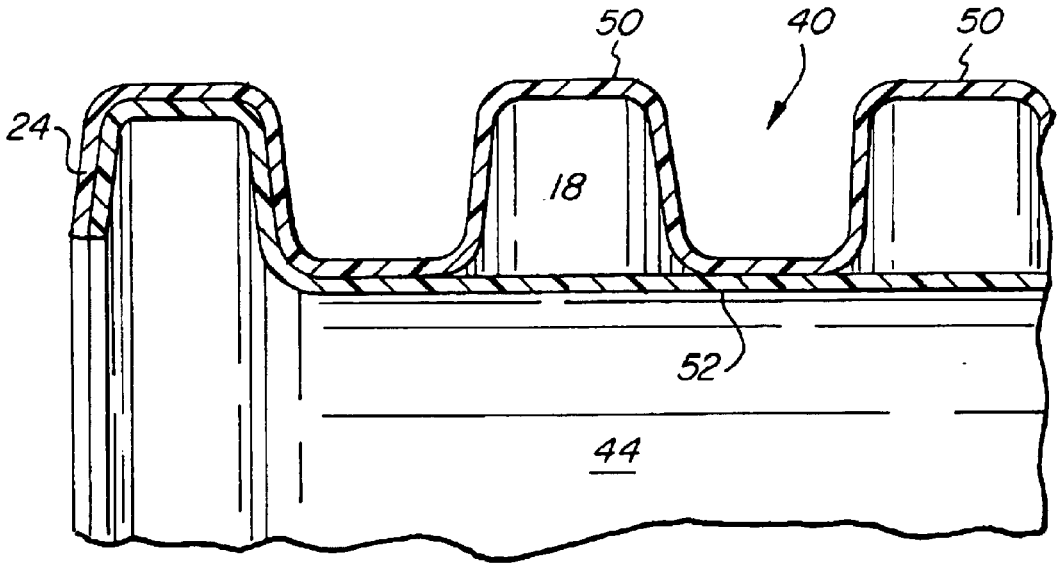
FIG. 10 is a cross-sectional view of the section of FIG. 7 along the line 10—10.
Figure 11:
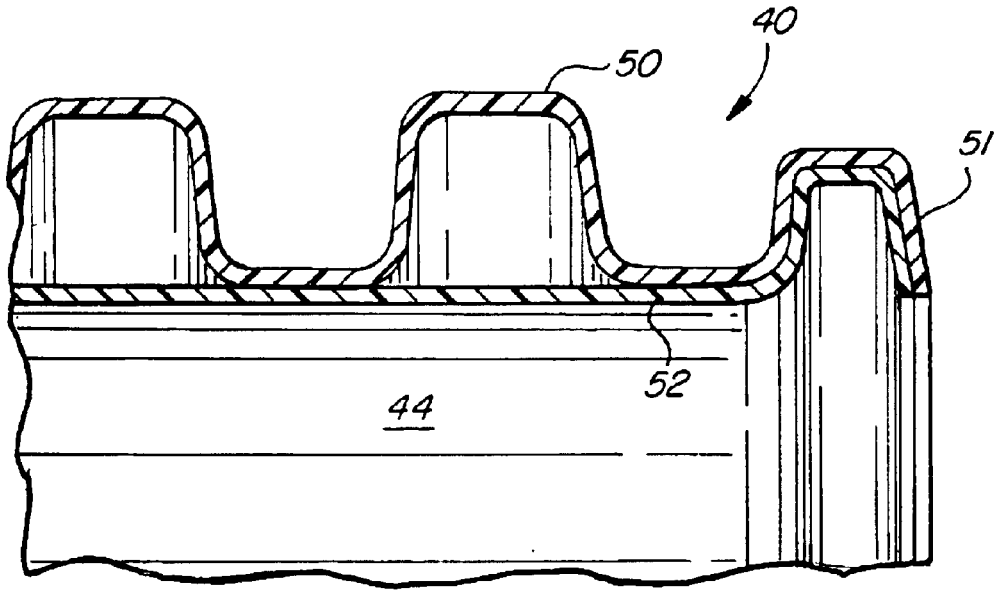
FIG. 11 is a cross-sectional view of the section of FIG. 7 along the line 11—11.

Referring to FIGS. 7, 10, and 11, the interior wall layer 52 extends from the second end 56, but at first end 54, the interior wall layer conforms to the ribbed outer layer 46 (or, alternatively, is terminated before the first end 54) thereby providing an open area below at least one upstanding rib 50 at the first end 54. The exposed upstanding ribs 50 at the first end 54 are larger in size than exposed upstanding rib 51 at the second end 56. Galleries 40 can easily be connected in an end-to-end fashion as an exposed upstanding rib 50 at the first end 54 of a first gallery 40 is fitted over the exposed upstanding rib 51 at the second end 56 of a second gallery 40. Alternatively, the gallery 40 may have multiple exposed upstanding ribs located at each end of the gallery 40.

In one embodiment, gallery 40 is provided with perforations 60, distributed along the length of the elongated section 42. The perforations 60 facilitate the flow of effluent out of the drain field gallery 40 in the adjoining leaching field if the gallery is to be used in a septic field or for wastewater management.

The end wall 32 illustrated in FIGS. 5, 6A and 6B may also be utilized with the gallery 40 in the same manner as described for use with the gallery 10 illustrated in FIG. 2.

Figure 9:
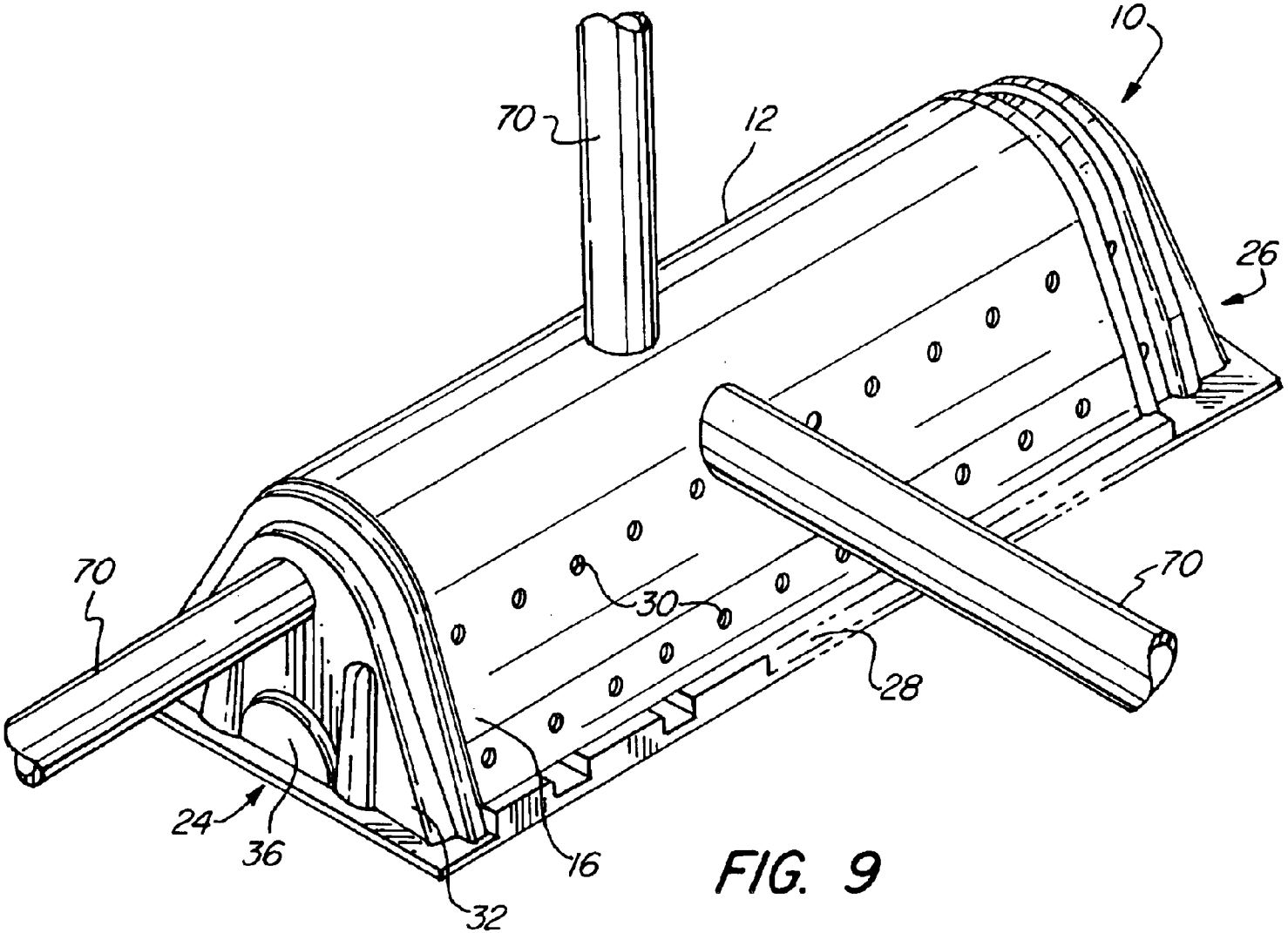
FIG. 9 is a perspective drawing an embodiment of the plastic gallery of the present invention assembled for use as a stormwater gallery.

FIG. 9 illustrates an embodiment of the present invention in a possible installed configuration. A gallery 10 is provided in accordance with the embodiment disclosed in FIG. 2 where drain and/or feed conduits 70 are shown entering the gallery 10 at various locations. For instance, the drain conduit 70 may feed into the first end 24 of the elongated section 12 through the end wall 32. Alternatively, the drain conduit may feed into the elongated section 12 through the side inlet or through a top inlet. The acceptable feed points into the gallery 10 may be indicated by perforations located on the side and top of the elongated section in the same manner as indicated in FIG. 5 illustrating concentric diameters, which may be cut according to the diameter of the pipe utilized. It should be noted that, although the embodiment of FIG. 2 is shown in FIG. 9, the alternate embodiment in FIG. 7 may also be utilized when feeding pipes into the elongated section from the side and/or the top, which would also include concentric perforations to indicate where to feed the pipe into the elongated section.

The polyethylene galleries described herein may be manufactured by many different methods. For instance, one method may include thermoforming a polyethylene sheet to a mold. A polyethylene sheet is heated and vacuum molded to a preformed mold. Once the polyethylene gallery has cooled, in order to retain the shape of the preformed mold, it is removed from the mold.

In the first embodiment of FIG. 2 comprising three layers of sheet material, a molded ribbed sheet comprises the middle layer and is sandwiched between smooth continuous exterior and interior layers, which are similarly formed or shaped before assembly with the ribbed sheet. The three layers are then welded together or secured together with mechanical fasteners.

In the second embodiment of FIG. 7, comprising two layers of sheet material, the molded arched ribbed sheet comprises the exterior layer, which is joined to an arched, smooth continuous interior layer. Again, as in the first embodiment, these layers may be secured to one another by welding or mechanical means.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A multi-layer gallery having an elongated arched body and first and second ends, the elongated arched body forming an elongated arched interior space with an open bottom for liquid to flow therethrough, the multi-layer gallery comprising:

a first exterior layer forming a smooth continuous surface along a substantial length of the gallery;

a second middle layer forming a plurality of spaced apart upstanding ribs along a length of the gallery; and a third interior layer forming a smooth continuous surface along a second substantial length of the gallery;

a connecting mechanism located at the first and second end of the multi-layer gallery for connecting the gallery together with another gallery in an end-to-end relationship, the connecting mechanism comprising a starting rib located at the first end of the gallery, and an end rib located at the second end of the gallery, such that a first gallery and a second gallery may be connected together by overlapping a starting rib of the first gallery over an end rib of the second gallery.

2. The multi-layer gallery of claim 1 wherein said starting rib is larger than the end rib.

3. The multi-layer gallery of claim 2 wherein the third interior layer extends from the second end of the gallery and terminates prior to the first end of the gallery at the last upstanding rib of the second middle layer.

4. The multi-layer gallery of claim 3 wherein there are multiple exposed upstanding ribs at each end of the gallery.

5. The multi-layer gallery of claim 1 further comprising an end wall located at the second end of the gallery.

6. The multi-layer gallery of claim 5 wherein said end wall is integral to the gallery.

7. The multi-layer gallery of claim 5 wherein said end wall is detachably connectable to the second end of the gallery.

8. A multi-layer gallery having an elongated arched body and first and second ends, the gallery forming an elongated arched interior space with an open bottom for liquid to flow therethrough, the multi-layer gallery comprising:

a first exterior layer running transversely to the length of the elongated arched body forming a plurality of spaced apart upstanding ribs;

a second interior layer forming a surface which is sufficiently smooth to reduce frictional drag of liquids flowing in the gallery;

said first exterior layer extending from the first end of the elongated section to the second end of the elongated section; and said second interior layer extending from the first end of the elongated section and terminating prior to the second end of the elongated section to form a connecting mechanism; said connecting mechanism comprising a starting rib located at the first end of the gallery, and an end rib located at the second end of the gallery, wherein a first and a second gallery may be connected together by overlapping a starting rib of the first gallery over an end rib of the second gallery, said starting rib being larger than the end rib, and the second interior layer extending from the second end of the gallery and terminating prior to the first end of the gallery at the last upstanding rib of the first exterior layer.

9. The multi-layer gallery of claim 8 wherein there are multiple exposed upstanding ribs at each end of the gallery.

10. The multi-layer gallery of claim 8 further comprising an end wall located at the second end of the gallery.

11. The multi-layer gallery of claim 10 wherein said end wall is integral to the gallery.

12. The multi-layer gallery of claim 10 wherein said end wall is detachably connectable to the second end of the gallery.

13. A method for providing a multi-layer gallery with an elongated arched body having first and second ends and having a reduced coefficient of friction for an interior space with an open bottom to facilitate the flow of liquid and particles therethrough, including the steps of:

providing a first exterior layer, the first exterior layer forming a plurality of upstanding ribs spaces apart along the elongated arched body and running transversely to the length of the elongated arched body;

providing a second interior layer, the second interior layer forming a smooth continuous surface;

adhering the first exterior layer to the second interior layer to form a single multi-layer gallery;

extending the first exterior layer from the first end of the elongated section to the second end of the elongated section; and extending the second interior layer from the first end of the elongated section and terminating prior to the second end of the elongated section at the last upstanding rib of the first exterior layer to form locking mechanisms.

14. The method of claim 13 further including the steps of providing the locking mechanisms located at the first and second ends of the multi-layer gallery such that multi-layer galleries may be locked together in an end-to-end fashion.

15. The method of claim 14 wherein further including the steps of overlapping an end rib located at the second end of the elongated section of a first multi-layer gallery on a starting rib located at the first end of the elongated section of a second multi-layer gallery.

16. The method of claim 13 further including the steps of locating an end wall at the second end of the elongated section.

17. A plastic gallery for containing and distributing liquid in a leaching or drain field, said gallery comprising:

an elongate arched body having first and second ends and an open bottom, said arched elongate body being formed of a corrugated layer and an inner plastic layer, said corrugated layer being a corrugated plastic having a plurality of ribs extending along a substantial length of said elongate body, said inner plastic layer being affixed to an inner surface of said corrugated layer and having a substantially smooth inner surface extending along a substantial length of said elongate arched body, said substantially smooth inner surface having a low frictional drag with respect to liquid flow;

said corrugated layer extending from the first end of the elongated to the second end of the elongated section; and said inner plastic layer extending from the first end of the elongated section and terminating prior to the second end of the elongated section at the last upstanding rib of the corrugated layer, to form a connecting mechanism associated with said first and second ends for connecting said gallery with another gallery.

18. A plastic gallery in accordance with claim 17, wherein said connecting means is adapted for connecting said gallery with another gallery in an end to end relationship, said connecting means comprising: one or more starting ribs located at said first end of said gallery, said inner layer being sized and located such that said inner layer is not affixed to said starting ribs, and one or more end ribs located at said second end of said gallery, said starting ribs being larger than said end ribs and being sized such that said starting ribs can be fitted over said end ribs to connect said gallery with another gallery.

19. A plastic gallery in accordance with claim 18, further comprising an end wall associated with said second end of said gallery.

20. A plastic gallery in accordance with claim 19, wherein said end wall is integrally molded with said corrugated layer.

21. A plastic gallery in accordance with claim 19, wherein said end wall is detachably located within said gallery.

22. A plastic gallery in accordance with claim 17, further comprising perforations in said inner layer and said corrugated layer.

23. A plastic gallery in accordance with claim 17, further comprising an outer layer being affixed to an outer surface of said corrugated layer and having a substantially smooth outer surface extending along a substantial length of said elongate arched body.

* * * * *